US006239762B1

(12) United States Patent
Lier

(10) Patent No.: US 6,239,762 B1
(45) Date of Patent: May 29, 2001

(54) INTERLEAVED CROSSED-SLOT AND PATCH ARRAY ANTENNA FOR DUAL-FREQUENCY AND DUAL POLARIZATION, WITH MULTILAYER TRANSMISSION-LINE FEED NETWORK

(75) Inventor: Erik Lier, Newtown, PA (US)

(73) Assignee: Lockheed Martin Corporation, Sunnyvale, CA (US)

( * ) Notice: Subject to any disclaimer, the term of this patent is extended or adjusted under 35 U.S.C. 154(b) by 0 days.

(21) Appl. No.: 09/496,524

(22) Filed: Feb. 2, 2000

(51) Int. Cl.[7] ..... H01Q 13/10

(52) U.S. Cl. ..... 343/770; 343/700 MS; 343/846

(58) Field of Search ..... 343/767, 770, 343/700 MS, 846

(56) References Cited

U.S. PATENT DOCUMENTS 5,608,414 * 3/1997 Amore ..... 343/700 MS
5,650,788 * 7/1997 Jha ..... 343/700 MS
6,018,319 * 1/2000 Lindmark ..... 343/700 MS

* cited by examiner

*Primary Examiner*—Tan Ho
(74) *Attorney, Agent, or Firm*—W. H. Meise

(57) ABSTRACT

A crossed-slot antenna in a first ground plane has a first feed, in stripline form including a second ground plane, which underlies a portion of one of the orthogonal slots for exciting a first polarization. A conductive lip of the other slot extends through the plane of the first feed, and opens through the second ground plane. A second feed includes conductors underlying the extended other slot. In a preferred embodiment, the feeds for the first and second slots are balanced. In a particularly advantageous embodiment, an array of such crossed slots is co-located with an array of enhanced-gain patch antennas.

7 Claims, 13 Drawing Sheets

INTERLEAVED CROSSED-SLOT AND PATCH ARRAY ANTENNA FOR DUAL-FREQUENCY AND DUAL POLARIZATION, WITH MULTILAYER TRANSMISSION-LINE FEED NETWORK

FIELD OF THE INVENTION

This invention relates to array antennas, and more particularly to co-located or common-aperture antenna arrays operating at disparate frequencies.

BACKGROUND OF THE INVENTION

For some applications, it is desirable to be able to use the same aperture area for a plurality of array antennas. In such interleaved or common-aperture arrangements, the operation of each array antenna is complicated by the presence of the other array, which adds mutual coupling between elements and interelement spacing problems. This problem is particularly acute when elliptical or circular (or dual linear) polarization is desired. Such a situation is described in U.S. Pat. No. 5,258,771, issued Nov. 2, 1993 in the name of Praba, in which two separate arrays of helical antennas, operable at different or disparate frequencies, are interleaved on (or using) the same ground plane. As described by Praba, the mutual coupling problem is solved, at least in part, by making the antenna elements of opposite hands of polarization. Grating lobes attributable to spacing of antenna elements are reduced by designing the helices so that the radiation pattern of the individual elements superposes nulls over the grating-lobe peaks. It should be understood that the ground plane, as described by Praba, has dual uses, the first being as a physical support for the antennas. The second use of the ground plane is equally important, if less obvious, and that is the use as an electrical terminus or ground, which allows the individual antenna feeds to be accomplished by means of transmission-line structures. Those skilled in the art know that it is very important in many contexts, including the electrical feed of antennas, to form the structures as transmission lines rather than as simple electrical conductors. In this context, the term "transmission line" connotes various factors such as low standing-wave ratio (SWR), controlled impedances (either the same at each point along the transmission line, or with at least somewhat matched transitions between different impedance levels), and low leakage or losses, except at locations where signal power transfer is desired.

A multiband phased-array antenna consisting of an L-band microstrip patch array interleaved with a linearly-polarized X-band slot array is described in an article entitled A Multiband Phased Array Antenna, by Edward, B. J., et al., published in Proceedings of the Sixteenth Annual Antenna Applications Symposium, Sep. 23–25, 1992. Such antennas are more desirable than helical antennas for those situations in which a planar or two-dimensional structure is preferred to a three-dimensional structure such as that of the Praba arrangement.

Improved interleaved antenna arrays are desired.

SUMMARY OF THE INVENTION

In its most general form, the invention lies in a crossed-slot antenna in a first ground plane, where the crossed-slot antenna has a first feed. The first feed is in stripline form, including a second ground plane, which underlies a portion of one of the orthogonal slots of the crossed-slot antenna for exciting a first polarization. A conductive lip of the other slot extends through the plane of the first feed, and opens through the second ground plane. A second feed includes conductors underlying the extended other slot. In a preferred embodiment, the feeds for the first and second slots are balanced. In a particularly advantageous embodiment, an array of such crossed slots is co-located with an array of enhanced-gain patch antennas.

More specifically, a crossed slot antenna arrangement according to an aspect of the invention includes a first ground plane or ground layer having radiating and nonradiating broad sides. The first ground plane defines a crossed slot antenna having first and second mutually orthogonal linear slots. These slots cross at a junction. Each of the linear slots includes a first and second portion. In a particular embodiment, the first and second portions of each linear slot are colinear, and separated by the junction. The crossed slot antenna arrangement also includes a first electrically conductive feed lying parallel with, and adjacent, the nonradiating side of the first ground plane, and extends across the first portion of the first linear slot for excitation thereof. A first dielectric layer lies between the nonradiating side of the first ground plane and the first electrically conductive feed, as a result of which, or whereby, the first electrically conductive feed takes on the general form of a first transmission-line structure. In a particular embodiment, the structure as so far recited is that of microstrip. A second electrically conductive feed lies parallel with the first ground plane and extends across the first portion of the second linear slot for excitation thereof. A second ground plane lies between the second electrically conductive feed and the first electrically conductive feed, thereby providing a second ground plane for the first transmission-line structure, and whereby the second electrically conductive feed takes on the form of a second transmission-line structure. In the particular embodiment, the presence of the second ground plane transforms the microstrip form of the first feed into a stripline structure. A second dielectric layer lies between the second electrically conductive feed and the second ground plane. A third ground plane extends parallel with the first ground plane, adjacent to the second electrically conductive feed, at a location remote from the second dielectric layer, for thereby providing a second ground plane for the second transmission-line structure. In the particular embodiment, the presence of the third ground plane transforms the second feed into a stripline form. An electrically conductive interconnection is coupled to at least the first portion of the second linear slot and to the third ground plane, without contacting the first and second electrically conductive feeds, for electrically interconnecting the second linear slot with the second transmission-line structure.

In a particular version of the crossed slot antenna arrangement, the first electrically conductive feed includes a further portion extending across the second portion of the first linear slot for excitation thereof, the further portion of the first electrically conductive feed including power splitting means for feeding the first and second portions of the first slot with substantially equal amplitudes. In another version of the crossed slot antenna arrangement, the second electrically conductive feed includes a further portion extending across the second portion of the second linear slot for excitation thereof, and the further portion of the second electrically conductive feed including power splitting means for feeding the first and second portions of the second slot with substantially equal amplitudes.

In a particular atavar of the invention, the first and second feeds are interconnected by a phase-shifting arrangement, for shifting the relative phases of signals provided by the first and second feeds to about 90° at a frequency within the operating frequency range of the crossed slot antenna arrangement.

In a yet further hypostasis of the invention, the crossed slot antenna arrangement further comprises a second electrically conductive interconnection arrangement coupled to at least the first portion of the first linear slot and to the second ground plane, without contacting the first and second electrically conductive feeds, for aiding in electrically interconnecting the first linear slot with the first transmission-line structure.

In a particularly advantageous version of the crossed slot antenna arrangement further includes at least one additional dielectric layer lying adjacent the radiating side of the first ground plane, the additional dielectric layer carrying a plurality of patch antennas overlying the radiating side of the first ground plane at locations other than those of the first and second slots, for radiating at a frequency higher than the operating frequency of the crossed slot antenna arrangement. A feed arrangement for the patch antennas includes apertures extending orthogonally between the patch antenna layer or plane, through the first, second, and third ground planes.

DESCRIPTION OF THE INVENTION

Figure 1:
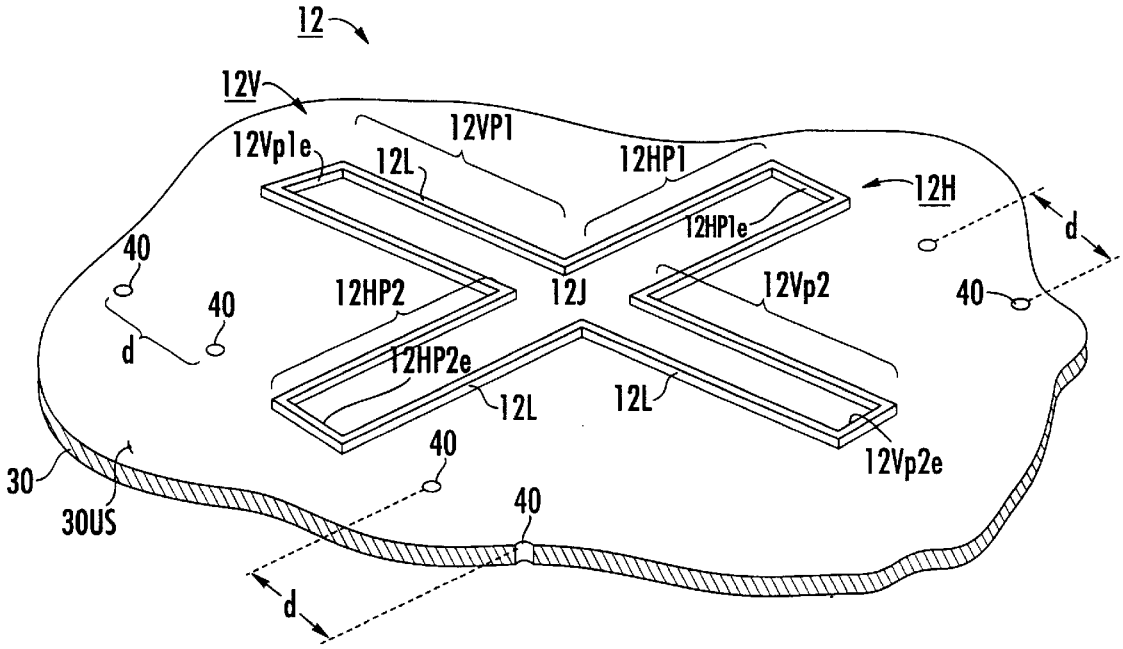
FIG. 1 is a simplified perspective or isometric view of a single crossed-slot antenna defined, together with certain apertures, in a ground plate.

FIG. 1 is a simplified diagram of a single crossed-slot "antenna" designated 12, to aid in defining certain portions of the crossed slot antenna. The term "antenna" is placed in quotation marks to suggest that the illustrated structure is not a complete antenna, in that, as illustrated, it lacks a feed structure. Since the physical structure of the slot per se is identical to that of the physical structure of the slot when associated with a feed to form an antenna, the context should be relied upon to indicate which is referred to. In FIG. 1, an electrically conductive ground plate or ground plane 30 defines a first "vertical" slot portion 12Vp1 co-linear with a second vertical slot portion 12p2V, which together form a co-linear slot 12V, and ground plane 30 also defines a first "horizontal" slot portion 12Hp1 co-linear with a second horizontal slot portion 12Hp2, to form a co-linear slot 12H. The sub-designation "12" identifies the designated portion as being part of the illustrated crossed-slot antenna 12, the sub-designations "V" and "H" identify two mutually orthogonal polarizations, as well known in the art, the sub-designations "p1" and "p2" identify particular "half-slots" of a co-linear combination of half-portions. The slots 12V and 12H cross at a slot junction 12J which is equidistant from the closed or short-circuited ends 12Vp1*e*, 12Vp2*e*, 12Hp1*e*, and 12Hp2*e* of slot portions 12Vp1, 12Vp2, 12Hp1, and 12Hp2, respectively.

While a ground "plane" has been adverted to, it should be noted that a physical object cannot actually lie in a plane, because a conceptual plane has no thickness. Instead, a statement that "an object lies in a plane" means that the object in question is at least generally (or locally) planar, and has a thickness, that the plane lies parallel with the plane of the object and within the thickness (or possibly at the surface) of the object. Thus, a ground plane is a conductive region of finite thickness, and need not be (but often is) planar. In a particular embodiment of the invention, the structure is supported by ground plate 30, which defines the slots.

It should further be noted in conjunction with FIG. 1 that the terms "vertical" and "horizontal" are not actual descriptive terms which suggest, or require, the designated physical orientation of the slots 12V and 12H of antenna 12, but are instead merely conventional terms which provide a convenient way to distinguish between the two mutually orthogonal portions of the structure or its radiation. Thus, these terms are understood in the art to be the equivalent of "first" and "second" polarizations, or other like designations.

As also illustrated in FIG. 1, crossed-slot antenna 12 has a projecting lip 12L which projects above the upper surface 30US of ground plane 30, where the term "upper" refers to orientation relative to the structure as illustrated. As described, the lip 12L projects only upward, but it may instead project downward, or both upward and downward.

As so far described in conjunction with FIG. 1, the direction of radiation of the crossed-slot antenna structure is not defined, because, among other things, the feed structure is not defined. Thus, radiation in the arrangement of FIG. 1 could be upward, downward, or both upward or downward. The term "radiation" and "feed" when applied to antennas, on its surface, appears to refer to the antenna as a radiating or transmitting structure. These terms were adopted at a time at which the knowledge of the functions of antennas was less complete than the current knowledge, and the terms are now understood to apply equally to an antenna in both its transmitting and receiving modes of operation. Thus, "radiating" a beam equally refers to the generation of an imaginary "beam" for receiving of signals from space, and the "feed" point or structure of an antenna is also the location or structure at which signal appears as a result of reception of electromagnetic energy from the surrounding space. The antenna may properly be understood as a bidirectional transducer for transducing between guided signals (at the "feed" end) in a transmission-line context and unguided "free-space" radiation (at the "radiating" end).

Figure 2:
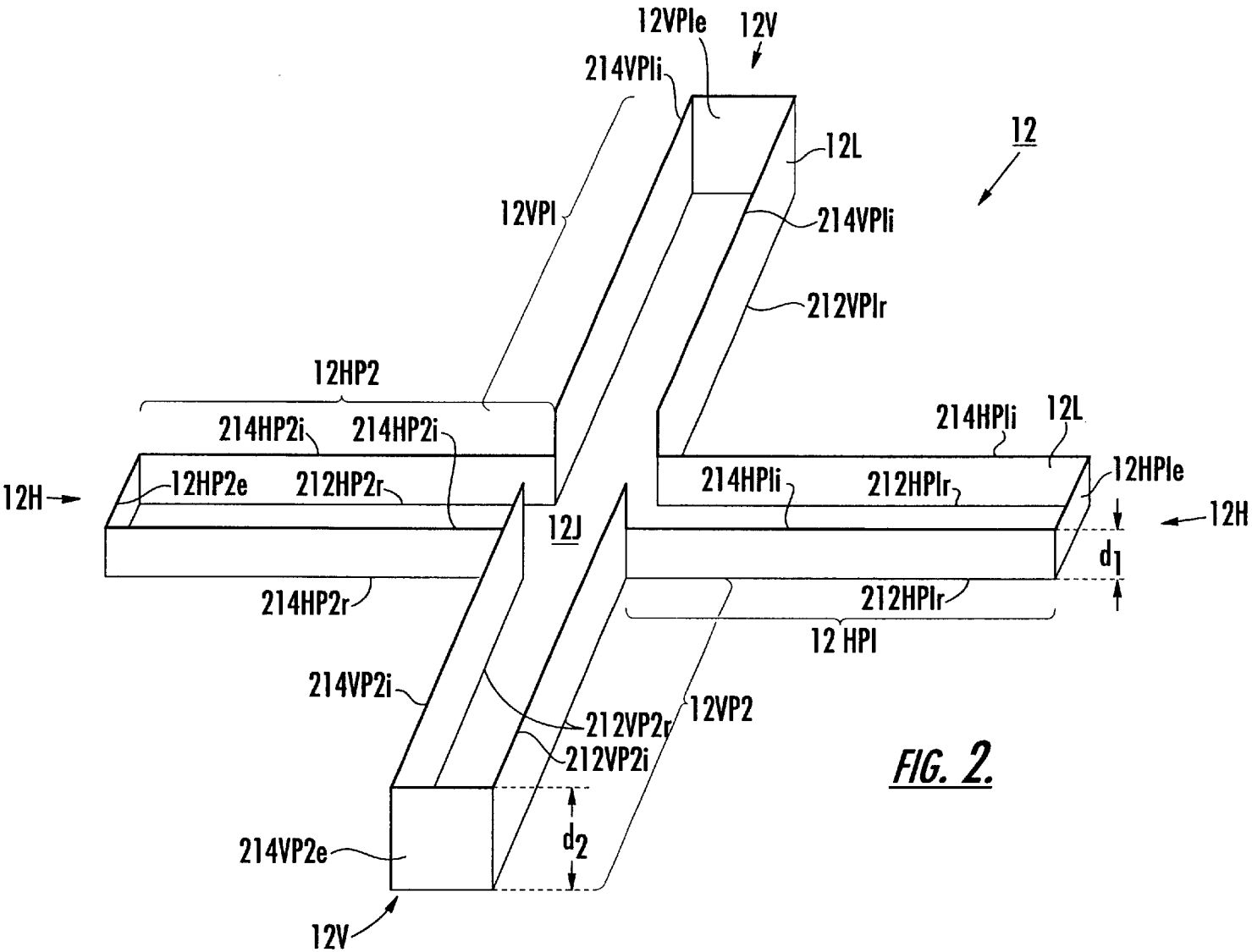
FIG. 2 is a simplified diagram, in perspective or isometric view, of a lip portion of the structure of FIG. 1.

As further illustrated in FIG. 1, ground plate 30 defines a plurality of through apertures, some of which are designated 40, arranged in a regular array near slot 12. The through apertures 40 are arranged in groups of four, and within each group of four, the spacing between mutually adjacent apertures is FIG. 2 is a simplified perspective or isometric view, partially cut away, of a single crossed-slot structure similar to that of FIG. 1, illustrating certain details of the lip 12L. Elements of FIG. 2 corresponding to those of FIG. 1 are designated by like reference numerals. In FIG. 2, the structure 12 may be imagined as being in the form of electrically conductive slot lips or edges 12L lying on a flat plane, and being coplanar in that plane. In order to be consistent in the use of reference designations, the direction of radiation of the slot is deemed to be downward, and "lower" slot edges 212VP1*r*, 212VP2*r*, 212HP1*r*, and 212HP2*r* are mutually coplanar, with the suffix "r" representing the "radiating" direction. As illustrated, however, the upper surfaces of the slots are not coplanar. More particularly, the upper surfaces 214HP1*i* of the first portion 12HP1 of slot 12H are coplanar with the upper surfaces 214HP2*i* of the second portion 12HP2 of slot 12H, and both extend a distance designated as dl above the plane defined by edges 212VP1*r*, 212VP2*r*, 212HP1*r*, and 212HP2*r*. Similarly, the upper surfaces 214VP1*i* of the first portion 12VP1 of slot 12V are coplanar with the upper surfaces 214VP2*i* of the second portion 12VP2 of slot 12V, and both extend a distance designated as d2 above the plane defined by edges 212VP1*r*, 212VP2*r*, 212HP1*r*, and 212HP2*r*. Distance or height dl is less than distance or height d2.

Figure 3:
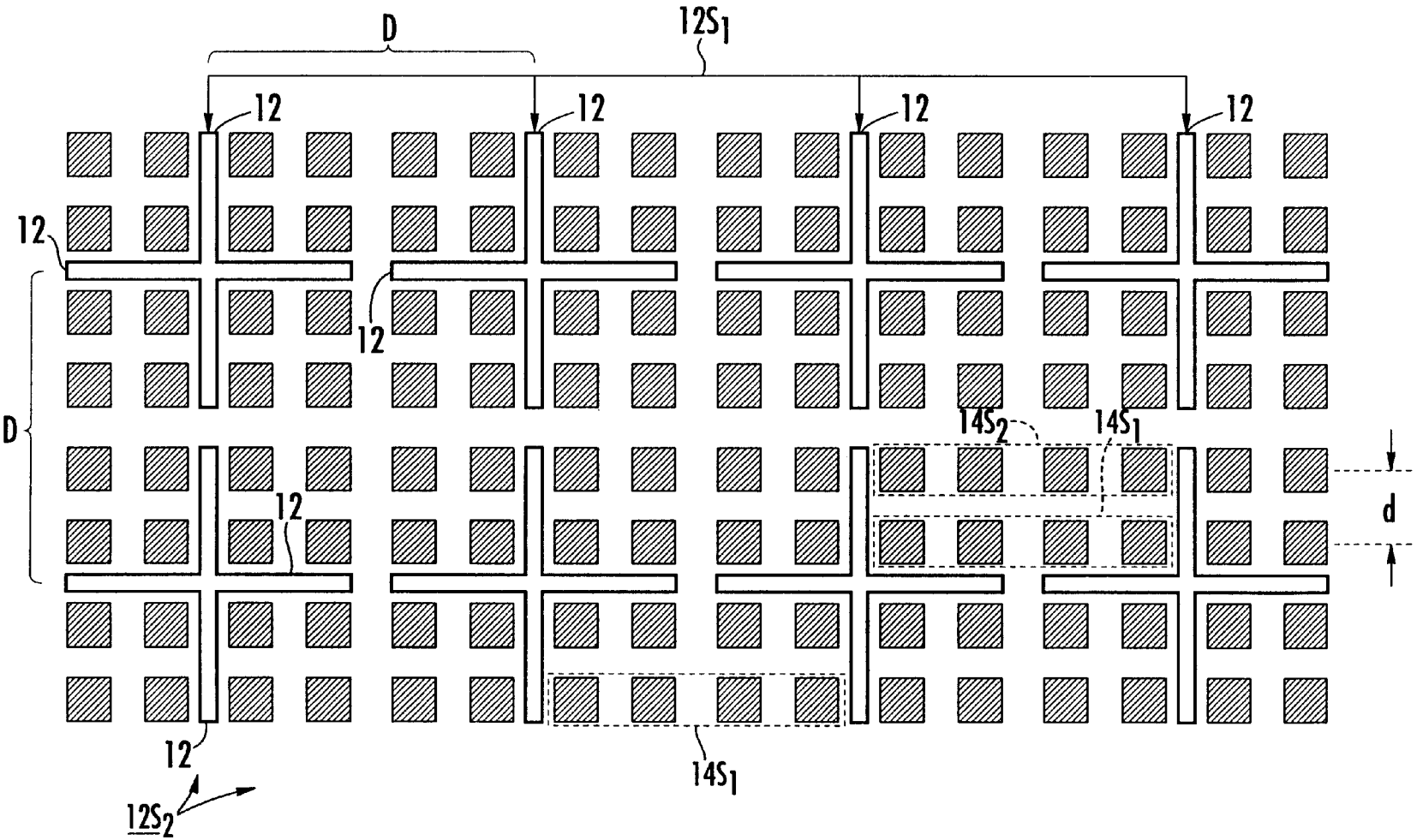
FIG. 3 is a simplified plan view of a portion of an interleaved antenna array arrangement according to an aspect of the invention.

FIG. 3 is a simplified diagram, in perspective or isometric view, of a portion of an interleaved antenna array according to an aspect of the invention. More particularly, the plan view of FIG. 3 may be considered to be a view of the "upper" or radiating side of the structure, with the feed structure on the reverse side and not visible in the illustration. In FIG. 3, an interleaved array 10 includes a plurality of crossed-slot sub-arrays, one of which is designated 12$s_1$, and a further crossed-slot sub-array is designated 12$s_2$. Sub-array 12$s_1$, includes four crossed-slot antenna elements, each corresponding to that of FIGS. 1 or 2, some of which crossed-slot antenna elements are designated 12. The four crossed-slot antennas 12 of sub-array 12$s_1$ are arranged in a linear array. Further sub-array 12$s_2$, located adjacent sub-array 12$s_1$, also includes four crossed-slot antenna elements 12, also arranged in a linear array. The crossed-slot antenna elements 12 are spaced apart from each other in each of sub-arrays 12$s_1$ and 12$s_2$ by a center-to-center spacing D, and the crossed-slot antenna elements 12 of sub-array 12$s_2$ are separated by a like spacing D from the corresponding crossed-slot antenna elements of sub-array 12$s_1$. Array 10 of FIG. 3 also illustrates a plurality of patch antennas 14, arranged in four-element sub-arrays 14*s*, one of which is designated 14$s_1$, and two others which are designated 14$s_2$ and 14$s_3$. As illustrated, each sub-array 14*s* of patch antennas lies between the half-slots of mutually adjacent slot antennas 12 of the array 10. The spacing between mutually adjacent patch antenna sub-arrays 14*s* is distance d, corresponding to the distance between mutually adjacent through apertures 40 of FIG. 1. Each patch antenna sub-array 14*s* is fed from "below" (the reverse side, not illustrated in FIG. 3) ground plate 30 through an aperture 40, as described in more detail below.

Figure 4:
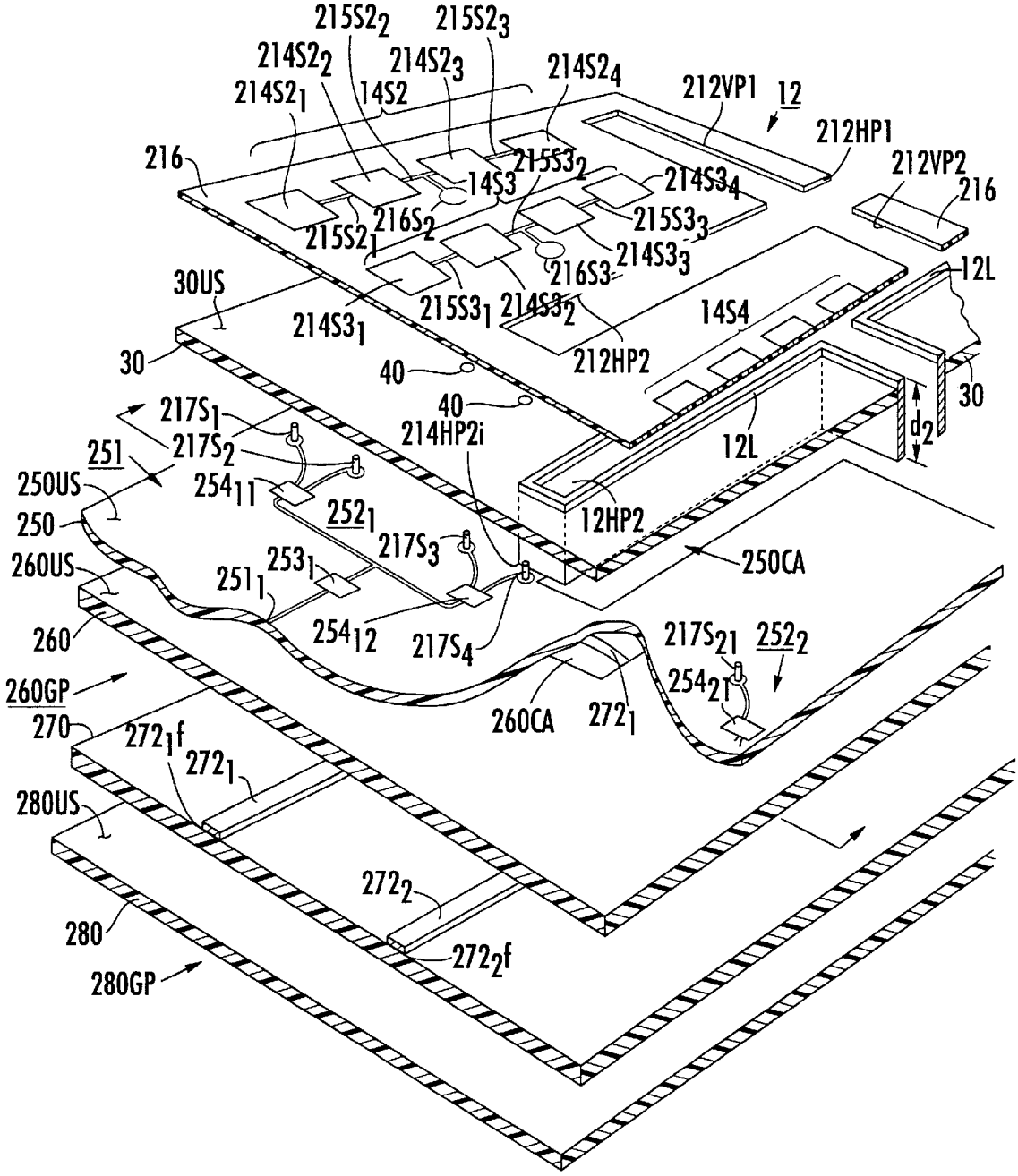
FIG. 4 is a simplified, perspective or isometric, exploded view of a portion of an array antenna arrangement 10 according to an aspect of the invention.

FIG. 4 is a simplified, perspective or isometric, exploded view of a portion of an array antenna arrangement 10 in one embodiment of the invention, to show the various portions thereof. In FIG. 4, a portion of ground plane 30 of FIG. 1 is overlain by a printed-circuit arrangement including a layer 216 of dielectric material, cut out in areas 212Hp1, 212Hp2, 212Vp1, and 212Vp2 to clear the corresponding portions of lip 12L of the slot antenna 12 of FIG. 1, so that dielectric layer 216 can lie flat against the radiating side or "upper surface" 30*us* of the ground plane 30. The upper or near surface of the illustrated portion of dielectric layer 216 is printed or otherwise has deposited thereon an electrically conductive pattern corresponding to a portion of the patch antenna array 14. More particularly, conductive regions or subarrays 14*s*2 and 14*s*3 are illustrated, together with a small portion of another conductive region designated generally as 14*s*4. Conductive region or patch antenna subarray 14*s*2 includes four patch antenna portions 214*s*2$_1$, 214*s*2$_2$, 214*s*2$_3$, and 214*s*2$_4$. Patch antenna portions 214*s*2$_1$, 214*s*2$_2$, 214*s*2$_3$, and 214*s*2$_4$ are interconnected by conductor paths 215*s*2$_1$, 215*s*2$_2$, and 215*s*2$_3$, and conductor path 215*s*2$_2$ is connected to a conductor pad 216*s*$_2$, which provides for electrical contact by means of an insulated conductor wire or stud 217*s*$_3$ extending through an aperture 40 in ground plate 30 to conductor paths of a feed arrangement associated with a dielectric layer 250. Similarly, conductive region or patch subarray 14*s*3 includes four patch antenna portions 214*s*3$_1$, 214*s*3$_2$, 214*s*3$_3$, and 214*s*3$_4$. Patch antenna portions 214*s*3$_1$, 214*s*3$_2$, 214*s*3$_3$, and 214*s*3$_4$ are interconnected by conductor paths 215*s*3$_1$, 215*s*3$_2$, and 215*s*3$_3$ to form a patch antenna subarray, and conductor path 215*s*3$_2$ is connected to a conductor pad 216*s*$_3$, which provides for electrical contact by means of an insulated conductor wire or stud 217*s*$_4$ extending through another aperture 40 in ground plate 30 to conductor paths of the feed arrangement associated with a dielectric layer 250. It will be apparent to those skilled in the art that the feed for each of the patch antenna subarrays 14*s*2 and 14*s*3 is applied in the center of the patch antenna subarray, and thus the two halves (two patches) of each subarray are fed in parallel.

In FIG. 4, a portion of a feed structure for patch antenna subarrays 14*s*2, 14*s*3, and 14*s*4 is illustrated in conjunction with a layer of dielectric material 250 underlying the ground plate 30. Dielectric sheet 250 is cut away in a slot region 250CA, to allow the protruding lower lip 214HP2*i* of slot antenna portion 212Hp2 to extend therethrough. The upper surface 250US is metallized, in known fashion, with a feed transmission line structure 251 including a feed point 251$_1$.

As mentioned, antennas are transducers between guided and unguided waves, and the transmitting and receiving functions of antennas are reciprocal, so the terms "feed" or "feed point" as applied to antennas do not refer only to transmit antennas. Instead, the "feed point" in a receive antenna is that point at which the received signals are taken from the antenna for use. The reciprocal relationship between transmit and receive antennas is such that the antenna "beam" exists in both transmit and receive modes of operation, and has the same characteristics. Similarly, an antenna presents the same impedances to its feed point in transmit and receive modes of operation.

Feed point $\mathbf{251}_1$ couples signal to a 3 dB power divider $\mathbf{253}_1$, which divides the amplitude of the signal in two, and applies one portion of the signal to a further power divider $\mathbf{254}_{11}$ and another portion to a power divider $\mathbf{254}_{12}$. Each of power dividers $\mathbf{254}_{11}$ and $\mathbf{254}_{12}$ in turn splits the applied signal into two equal-amplitude portions, for application over a stud or conductor to the feed points of corresponding ones of the patch antenna subarrays. More particularly, the signal portions produced at the output ports of power divider $\mathbf{254}_{12}$ are applied to conductive wires $\mathbf{217}s_3$ and $\mathbf{217}s_4$, and thence to feed pads $\mathbf{216}s_2$ and $\mathbf{216}s_3$ of patch antenna subarrays 14s2 and 14s3, respectively. That portion of the divided signal from power divider $\mathbf{253}_1$ which are applied to further power divider $\mathbf{254}_{11}$ is further divided into two equal portions, and applied to insulated conductors or studs $\mathbf{217}s_1$ and $\mathbf{217}s_2$, for feeding a further pair of patch antenna subarrays (not illustrated in FIG. 4). The feed network associated with sheet or layer 250 of FIG. 4 includes other feed portions, as for example the portion partially illustrated, including power divider $\mathbf{254}_{21}$, corresponding in function to divider $\mathbf{254}_{11}$. Divider $\mathbf{254}_{21}$ feeds an insulated wire or stud $\mathbf{217}s_{21}$, for feeding patch antenna subarray 14s4. Those skilled in the art recognize the feed arrangement of FIG. 4 as one which drives all elements of the patch antenna array 14 with equal amplitude and phase, for generating an antenna beam. They also recognize that, if the beam is to be scanned or directed away from a broadside direction, additional elements must be associated with the feed network, for controlling the relative amplitude andor the phase of the feed signals to the various patch antenna subarrays of the patch antenna array. Many different types of feed or beam-forming arrangements are known, any of which may be used in conjunction with the structure of FIG. 4.

It should be understood that the power dividers and any other structures placed on dielectric sheet 250 of FIG. 4 may have thickness greater than that of the deposited strip conductors, which may require that sheet 250 be spaced away from the lower side of ground plane 30; in any case, there must be a gap or insulation therebetween sufficient to prevent short-circuits. As so far described, the transmission-line structures defined on dielectric sheet 250 coact with the lower surface (not visible in FIG. 4) of ground plate 30, to form a type of transmission line known as "microstrip." Microstrip transmission lines, being open on one side, may have a tendency to radiate or otherwise interact with the environment.

A ground plane 260GP in the form of a dielectric sheet 260 with a metallized surface, such as upper surface 260US, underlies dielectric sheet 250 of FIG. 4, except in the region underlying the slots, such as slot 12Hp2. In the region underlying slot 12Hp2 and other slots, sheet 260 is cut away (not illustrated). Ground plane 260GP coacts with ground plate 30 and the transmission-line structures defined on dielectric sheet 250, to enclose the strip and other conductors, to thereby form or compose a "stripline" structure, which is less liable to interact with nearby structures. Instead of being on a separate dielectric sheet 260, the lower ground plane for the feed structures 251 could be simply an electrically conductive plating over relevant portions of the lower surface of dielectric sheet 250. However, the dielectric layer 260 is necessary for other purposes, and it is convenient to use it to support the lower ground plane.

A further feed structure is defined on the upper surface of a dielectric sheet 270 in FIG. 1. In FIG. 4, only a portion of the feed structure is illustrated, namely the feed ends $\mathbf{272}_1f$ and $\mathbf{272}_2f$, respectively, of two strip conductors $\mathbf{272}_1$ and $\mathbf{272}_2$. These feed conductors excite one or more portions of the horizontal portions of the crossed slot antennas, as more fully described below, by extending across a portion of the slot. In order to have the feed conductors extend across the slot, the dielectric sheet 270, unlike sheets 250 and 260, must extend across relevant slot portions. More particularly, strip conductor $\mathbf{272}_1$ may feed the second slot portion 12HP2 of the one crossed-slot antenna illustrated in FIG. 4, and strip conductor $\mathbf{272}_2$ may feed the corresponding slot portion of the next adjacent crossed-slot antenna (not illustrated in FIG. 4). When the upper surface 270US of dielectric layer 270 (and its plated conductor pattern including $\mathbf{272}_1$ and $\mathbf{272}_2$) is juxtaposed to the lower surface of dielectric layer 260, the strip conductors coact with the ground plane 260GP to form or define a "microstrip" transmission-line structure. As mentioned, a "stripline" structure is preferable, because of reduced interaction with its surroundings. A further ground plane layer 280GP may be plated onto the lower surface of dielectric layer 270, or to the upper surface 280US of the next lower layer 280, to thereby "enclose" the strip conductors $\mathbf{272}_1$ and $\mathbf{272}_2$ between ground planes 260GP and 280GP. As described below, the feed of an individual slot portion of a linear slot of a crossed-slot structure is accomplished by extending the strip conductor physically across the slot opening, as described at pages 26–50 of Microstrip Antennas—The Analysis and Design of Microstrip Antennas and Arrays, by D. Pozar et al., published by IEEE Press, 1995. In order for the slot portion to interact with the strip conductor of the feed, the slot must not be isolated from the strip conductor by a ground plane. Consequently, a cut-away or slot 260CA is made in ground-plane layer 260GP, at a location corresponding to slot portion 12HP2 (and other corresponding portions of other crossed-slot antennas). While in principle the ground-plane potentials or voltages will be the same, and it therefore does not matter, in principle, if the ground plane portions are connected at any particular point, it is considered to be best to make a positive electrical connection between the lower edge 214HP2*i* of the slot lip with the ground-plane 260GP around the edge of cutout or slot 260CA.

With the structure as so far defined, the linear slot portion 12H is excited or driven by signal applied to conductor strip $\mathbf{272}_1$, which passes under a portion of the slot 12HP2. It is believed to be desirable for improved balance to feed both slot portions of each linear slot. In the context of the antennas as so far described, this requires that signal applied to feed strip conductor $\mathbf{272}_1$ be applied in equal amplitudes to feed slot portions 12HP1 and 12HP2 of linear slot 12H. If circular or elliptical polarization is required, the feed structure must similarly apply signals (with a phase shift) to drive both slot portions 12VP1 and 12VP2 of linear slot 12V. Naturally, an antenna capable of providing substantially circular polarization can also be configured to provide individual orthogonal linear polarizations.

Figure 5:
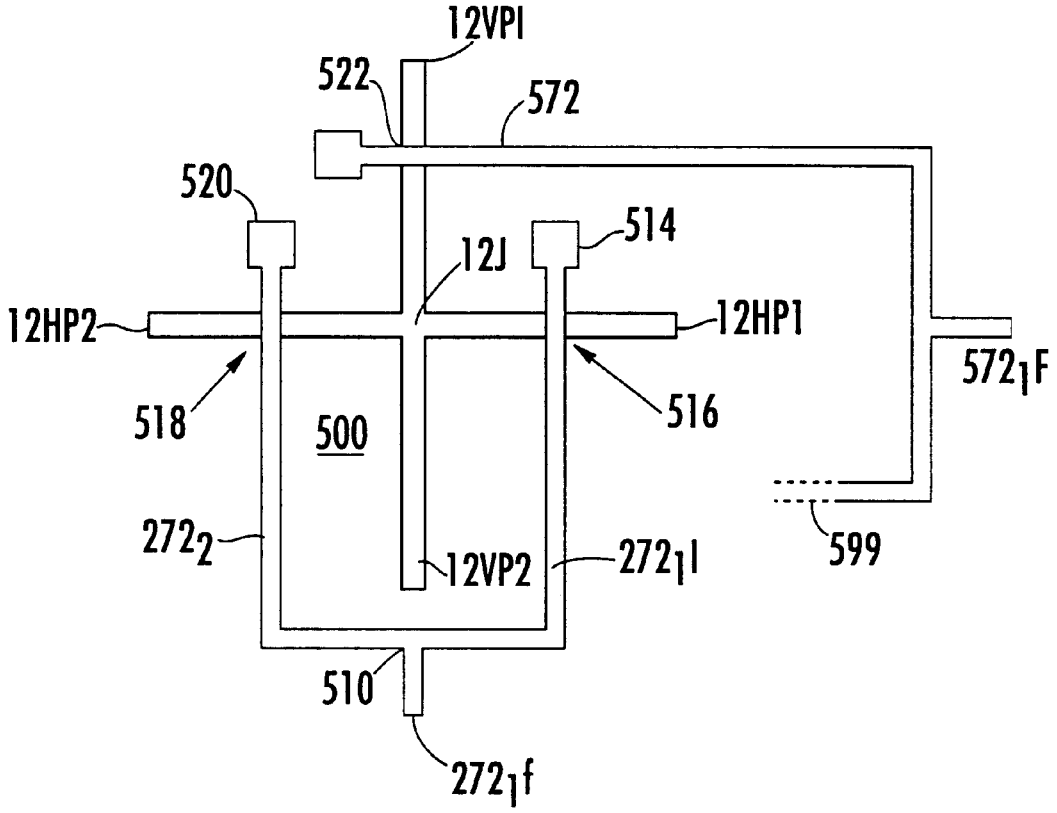
FIG. 5 is a simplified "plan-view" representation of a crossed-slot antenna with balanced planar feed for one linear slot, and also showing the locations at which drive is required for balanced excitation of the other linear slot.

FIG. 5 is a simplified "plan-view" representation of a crossed-slot antenna with balanced planar feed for one linear slot, and showing the locations at which drive is required for balanced excitation of the other linear slot. More particularly, FIG. 5 may be considered to be a representation of crossed-slot 12 of FIG. 4, showing only feed conductor 2721 and one other feed conductor 572.

In FIG. 5, the feed point $\mathbf{272}_1f$ connects to a power divider or splitter in the form of a simple junction 510. As known, such a simple junction will divide power equally if the impedances of the two branches as presented to the junction are equal. The divided signal power flows from junction 510 along two separate transmission-line structures $272_1$1 and $272_1$2. The signal flowing in path $272_1$1 flows across a portion of slot 12HP1 (at a location 516) to a capacitive termination 514. Similarly, the signal coupled into strip conductor $272_1$2 at junction 510 flows, at location 518, across a portion of slot 12HP2, and to a capacitive termination 520. Such capacitive terminations are known per se, as for example from M. J. Povinelli, Further Characterization of Wideband Dual Polarized Microstrip Flared Slot Antenna, Proceedings of the 1988 IEEE AP-S International Symposium, Syracuse, N.Y., pp712–715, June 1988. As so far described, the feed structure of FIG. 5 is planar, in that feed point **$272_1$*f*, splitter 510, strip conductors $272_1$1 and $272_1$2, and terminations 514, 520 all lie in the same plane, which, in one embodiment, is the plane of the metallizations on a dielectric substrate. Also, as so far described, the excitation of slot 12H is balanced, in that slot portions 12HP1 and 12HP2 are driven with equal amplitudes and corresponding phase. In order to excite slot 12V, a further feed conductor 572, coplanar with the other conductors, extends at a location 522 across vertical slot portion 12VP1. In order to achieve balanced excitation of slot 12V, an additional conductor would have to extend across slot portion 12VP2. However, it is not possible to route the second coplanar conductor from feed point $572_1$*f* to feed linear slot portion 12VP2, because slot portion !@VP2 is "landlocked" by the presence of slot 12HP1 (the feed for slot portion 12V1 should not extend across and thereby feed slot portion 12HP1) and conductor portions associated with feed of slot portions 12HP1 and 12HP2. The "missing" portion of the feed for the vertical slot portion 12VP2 is illustrated by a dash-line transmission path 599**.

In order to feed a crossed-slot antenna with balanced feeds according to an aspect of the invention, the transmission-line feeds for the vertical and horizontal slot portions are placed in different planes, by the use of multiple layers of metallization, which may be on separate PC boards, if necessary. In order to avoid unwanted coupling between the feeds, it is necessary to extend the lips of the slots to ground planes which occur at different layers of the printed-circuit board feed structure.

Figure 6:
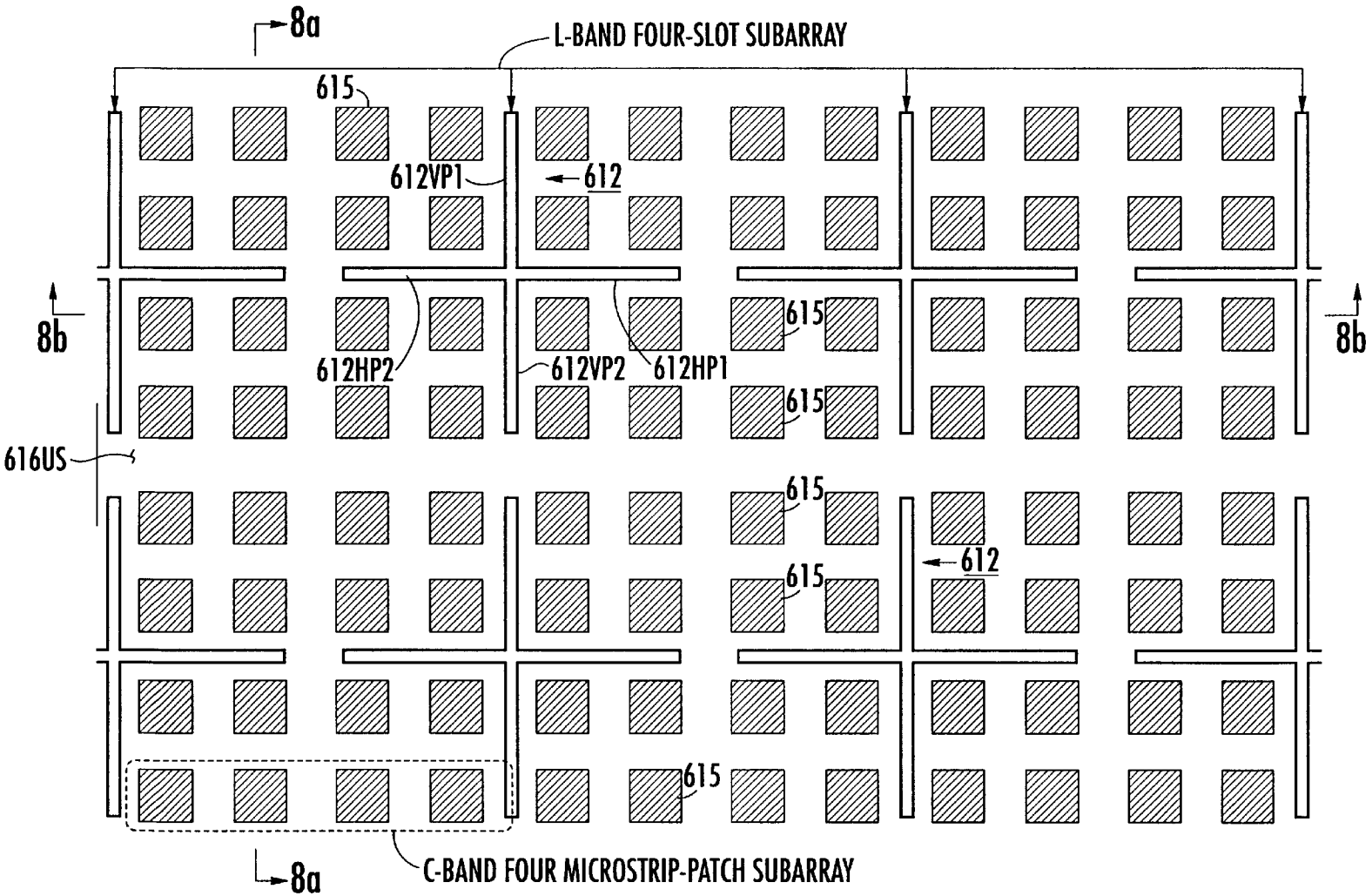
FIG. 6 is a plan view of a portion of the first or uppermost layer of an array of L-band crossed slot antennas co-located with an array of enhanced-gain C-band patch antennas, somewhat corresponding to the uppermost surface of the arrangement of FIG. 4.

FIG. 6 is a plan view of a portion of the uppermost layer of an array of L-band crossed slot antennas co-located with an array of enhanced-gain C-band patch antennas, somewhat corresponding to the uppermost surface of the arrangement of FIG. 4. In FIG. 6, the uppermost layer is a layer of dielectric material having upper surface 616US, with crossed-slot apertures, some of which are designated 612, cut therethrough at locations which are selected to be registered with at least some of the radiating slots of another layer. The uppermost surface 616US also bears a pattern of conductive director patches, some of which are designated 615, each of which is illustrated as being square, in a set of 4X4 patterns corresponding to the pattern of patch antennas of FIG. 4. As is known in the art, directors 615 are non-driven or parasitic elements which are provided to modify or enhance the flow of electromagnetic radiation of its associated radiating element (not visible in FIG. 6). In the particular embodiment, the parasitic elements are provided for "directing" the energy from a patch antenna, to achieve higher gain than that provided by the patch antenna alone. That portion of surface 616US which lies between the slot portions of four adjacent crossed-slot antennas 612 contains sixteen director patches 615, arranged in a rectangular 4×4 array.

Figure 7:
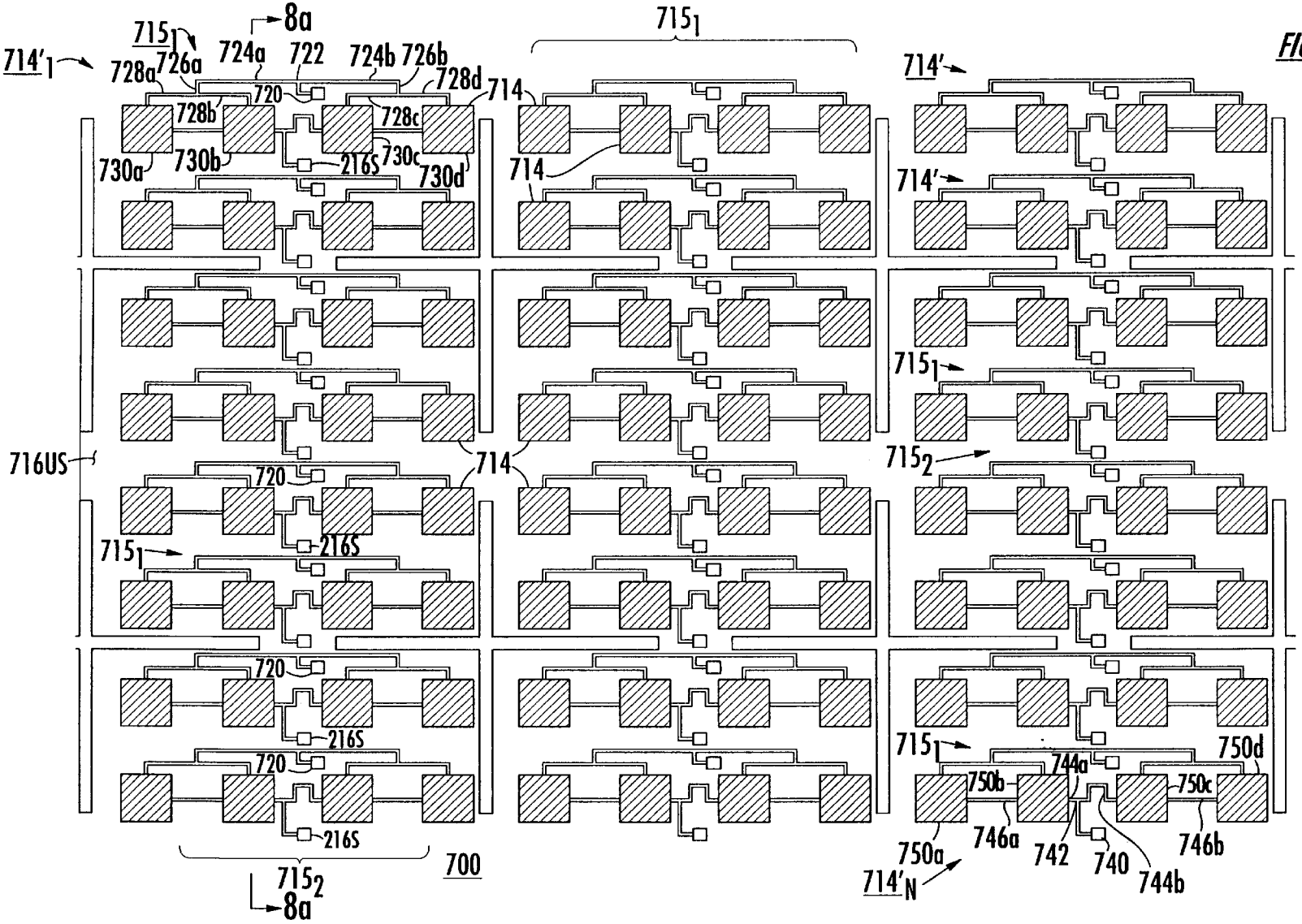
FIG. 7 is a representation of the second layer of the array of L-band crossed slot antennas co-located with an array of enhanced-gain C-band patch antennas associated with the layer of FIG. 6.

FIG. 7 is a representation of the second layer 700 of the array of L-band crossed slot antennas co-located with an array of enhanced-gain C-band patch antennas associated with the layer of FIG. 6. Second layer 700 lies under first layer 600 of FIG. 6 in an embodiment of the array of L-band crossed slot antennas co-located with an array of enhanced-gain C-band patch antennas associated with FIG. 6. In FIG. 7, the upper surface of the second layer of dielectric is designated 716US. Upper surface 716US bears a rectangular pattern of individual patch antennas, some of which are designated 714 for identification. The rectangular pattern is intended to be such as to register each patch director 615 of FIG. 6 over a corresponding one of the patch antenna elements 714 of FIG. 7. The patch antenna elements 714 of FIG. 7 are driven or fed by patterns of electrically conductive strips which, in the completed structure, co-act with a ground plane (not illustrated in FIG. 7) to form microstrip transmission line structures. The feed structures will be recognized by those skilled in the art as being for feeding the patch antenna elements 714 in four-element inline subarrays, some of which are designated 714'. In FIG. 7, some of the feed structures of a first type are designated $715_1$, while some of the feed structures of a second type are designated $715_2$. These two types of feed structures are intended to independently excite the patch antennas 714 with (or for) first and second polarizations, respectively. Each four-element subarray 714' is associated with one type $715_1$ feed structure and one type $715_2$ feed structure. More particularly, at the upper left of FIG. 7, representative four-patch-antenna subarray $714'_1$ includes a feed structure $715_1$ for the first polarization. Feed structure $715_1$ for four-element subarray $714'_1$ includes a metallization pad 720 at the location of a through aperture (not separately illustrated) fitted with a feed pin corresponding to a feed pin such as $217S_2$ of FIG. 4. Metallization pad 720 couples signal between the associated feed pin and the associated four-patch-element feed network $715_1$ by way of a conductive strip transmission path including a power-splitting junction 722, transmission paths **724*a* and 724*b*, further power-splitting junctions 726*a* and 726*b*, and further conductive paths 728*a*, 728*b*, 728*c*, and 728*d*, all of which feed one side, illustrated as the upper side in FIG. 7, of the four conductive patches 730*a*, 730*b*, 730*c*, and 730*d*, respectively, of four-patch subarray $714'_1$, for thereby exciting (or, as mentioned, being excited by) the first polarization. As mentioned, the first polarization may be considered to be, or be designated as, either "V" or "H". Each four-element subarray 714' of FIG. 7 is associated with a first-polarization feed $715_1$ similar or identical to that of subarray $714'^1$**.

In the array of L-band crossed slot antennas co-located with an array of enhanced-gain C-band patch antennas of FIG. 7, each four-element subarray 714' of patch antennas is associated with a feed network $715_2$ for the second polarization. A representative feed network 7152 is described in conjunction with a subarray $714'^N$ of four patch antenna elements **750*a*, 750*b*, 750*c*, and 750*d*, at the lower right of FIG. 7. Representative feed network $715_2$ includes a metallization pad 740 (corresponding in principle to pad 216S2 of FIG. 4) which is registered with the location of a through aperture (not illustrated) which extends through other layers of the structure, and is dimensioned to accommodate a conductive feed pin equivalent to pin $217S_1$ of FIG. 4. Thus, metallization pad 740 communicates signal between the four patch antenna elements of subarray $714'^N$ and a source or sink of signal which are located at other levels of the structure. Feed structure 7152 of subarray $714'^N$ includes a power-splitting (or power-combining, for reception operation) junction 742, and conductive paths 744***a* and 744*b*, which carry signal between the junction 742 and the sides of patch antennas 750*b* and 750*c*, respectively. As illustrated in FIG. 7, that portion 744*b* of the signal-carrying transmission line extending from junction 742 to patch 750*c* is longer than portion 744*a* which feeds patch 750*b*, to correct a phase error which is introduced by feeding the four-patch-antenna array in its center. The feed structure for the patch antenna subarray $_{714}$ N also includes further strip conductors 746*a* and 746*b*, which carry excitation between patch antenna element pairs 750a/750*b* and 750c/750*d*, respectively. Excitation of patch antenna subarray 714$'^N$ in the second polarization is provided to patches 750*b* and 750*c* by way of metallization pad 740, splitting junction 742, and paths 744*a* and 744*b*, respectively. Excitation in the second polarization for patch antenna elements 750*a* and 750*d* of subarray 714$'^N$ is provided through their adjacent patch antenna elements 750*b* and 750*c*, respectively, by way of strip conductors 746*a* and 746*b*, respectively. Naturally, patch antenna subarray 714$'^N$ also has an associated first-polarization feed 715$_1$, as do all of the other four-patch-antenna subarrays 714'. The first-polarization feed is described in conjunction with representative four-patch-element subarray 714'$_1$.

Figure 8A:
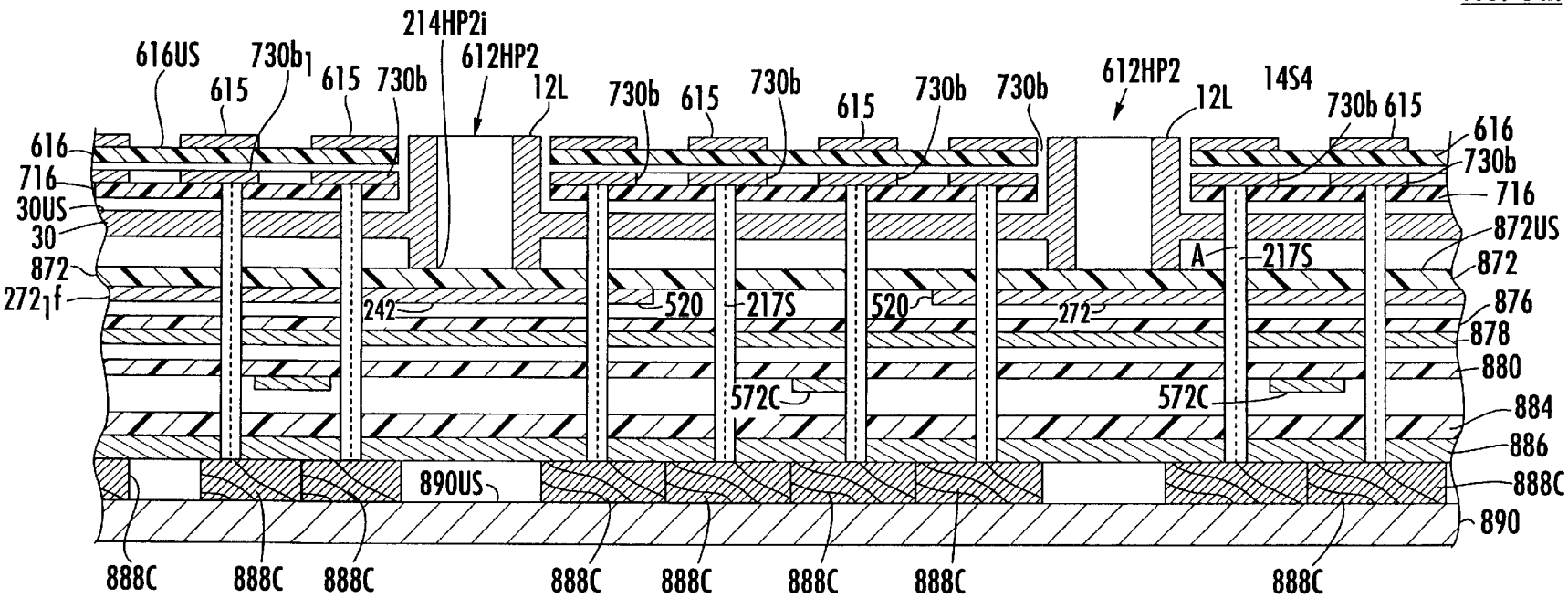
FIGS. 8*a* and 8*b* are cross-sectional representations of an antenna structure, portions of which are illustrated in FIGS. 6 and 7; the cross-sections are taken at right angles to each other, to illustrate the different depths to which the lip of the third layer slots penetrate.

FIG. 8*a* is a simplified cross-section of the array of L-band crossed slot antennas co-located with an array of enhanced-gain C-band patch antennas of FIGS. 6 and 7.

In FIG. 8*a*, the cross-section is taken looking along section axis 8*a*–8*a* of FIG. 6. In FIG. 8*a*, the uppermost layer (the layer illustrated in plan view in FIG. 6) includes a layer 616 of dielectric sheet, on which the directors 615 are deposited, in locations registered with patch antennas 730. In the view of FIG. 8*a*, the patch antennas lie on dielectric sheet 716, and all the patch antennas are seen as 730*b* antennas, because the view is taken through all the 730*b* patches of one line array. The arrayed patch antennas 730*b* of FIG. 8*a* are discontinuous at the location of slots 612HP2, because the lip 12L of the slots penetrate through the patch antenna layer. A metallic layer, which in one embodiment of the invention may be a support plate, and in another embodiment may be a simple metallization layer affixed to the bottom of dielectric film layer 716, makes electrical contact with lip 12L.

Below ground plane 30 and the bottom edge 214HP21 of lip 12L in FIG. 8*a*, a further dielectric layer 872 extends across the structure in the cross-section, supporting the feed electrical conductors 272, and electrically insulating the feed conductors 272 from the bottom 214HP2*i* of lip 12L. Thus, the feed conductors extend across slot aperture 612HP2 generally as illustrated in FIG. 5. As also illustrated in FIG. 5, the feed conductors 272 in FIG. 8*a* terminate in capacitive portions 520 on the "far" side of the slots which they excite. As mentioned, the feed conductors 272, in association with ground plane 30, form a transmission-line structure known as "microstrip." In the instant arrangement, "stripline" configuration is preferred, because of its improved isolation. To convert the microstrip form to a stripline form, a further ground layer 878, deposited on a support/isolation dielectric film 876, lies under feed conductor layer 272. Layers 880, 572*c*, 884, and 886 of FIG. 8*a* are described in detail in conjunction with FIG. 8*b*.

In FIG. 8*a*, the feed pins 217*s* for each of the patch antenna subarrays are illustrated as penetrating through layers 30, 872, 876, 878, 880, 884, and 886 to arrive at one of a plurality of C-band transmit-receive (TR) modules registered with the patch antenna subarray feed points 216*s* and 722 (FIG. 7), isolated from each of the layers which is penetrated by an aperture somewhat larger than the pin. As an alternative, of course, the pin could be separately insulated.

Figure 8B:
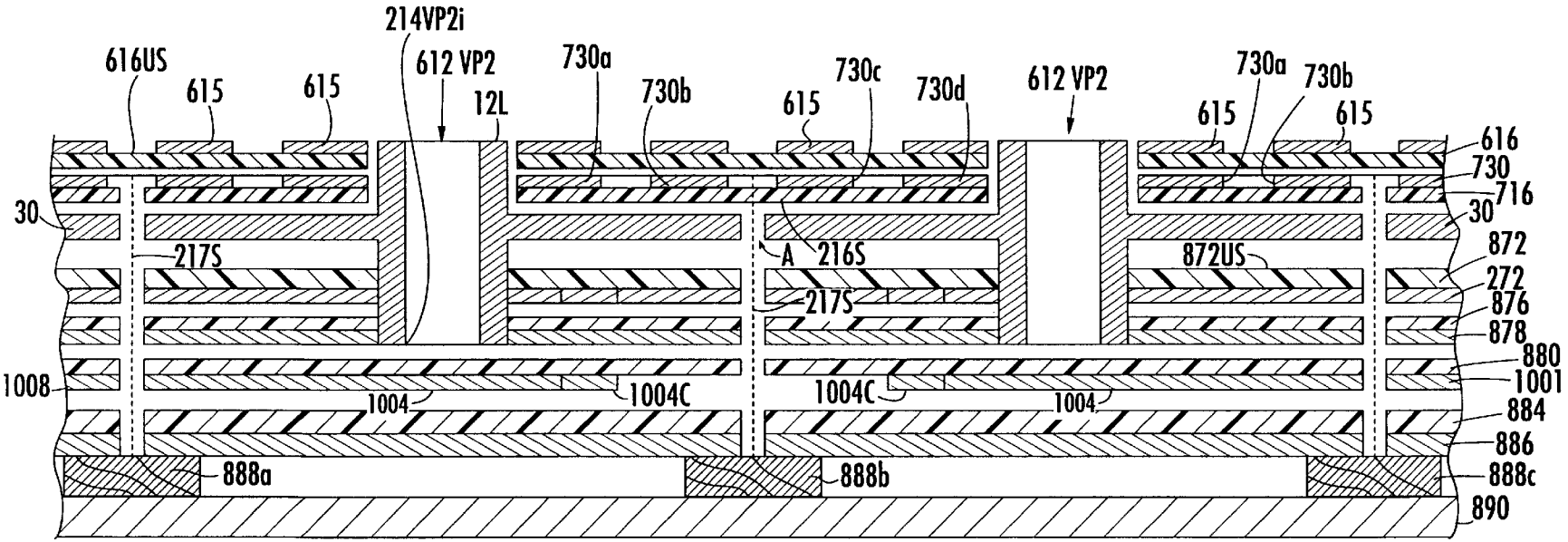
Figure 10:
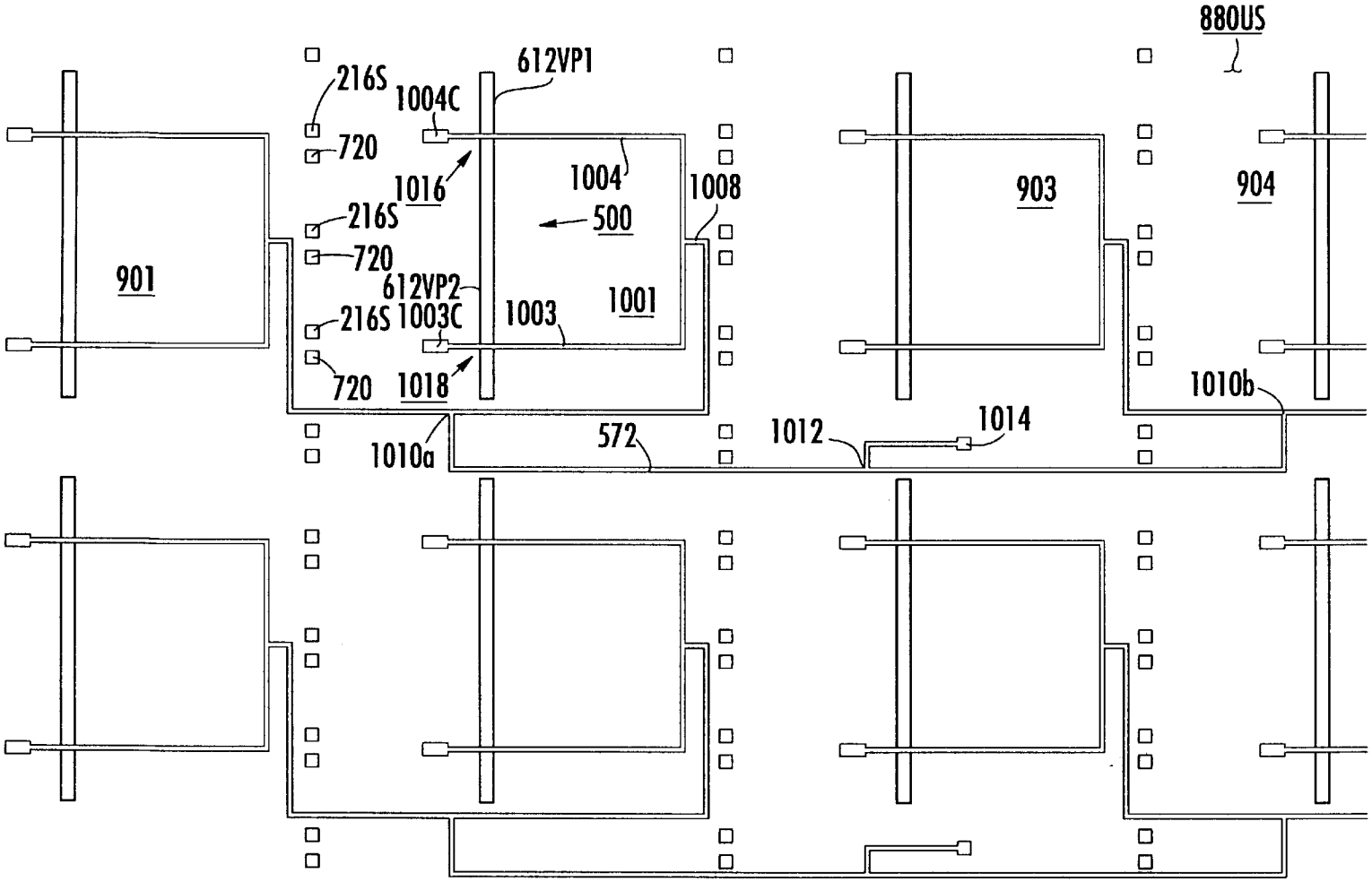
FIG. 10 is a simplified diagram illustrating the layout of a vertical-polarization slot feed layer of the array of L-band crossed slot antennas co-located with an array of enhanced-gain C-band patch antennas of FIGS. 6, 7, 8*a*, 8*b*, and 9.

FIG. 8*b* is a simplified cross-sectional view of the array of L-band crossed slot antennas co-located with an array of enhanced-gain C-band patch antennas of FIG. 8*a*, taken at right angles therewith, so that the visible slots include slot 612VP2 of FIG. 6. Layers 615, 616, 730*c*, 716, 30, 872, 272, 876, and 878 are described in conjunction with FIG. 8*a*. In FIG. 8*b*, the lower edge 214VP2*i* of lip 12L of slot 612VP2 penetrates through layers 616 and 716, as does slot 612HP2 of FIG. 8*a*, and additionally penetrates through layers 872 and 876, and makes contact with the ground plane 878 associated with dielectric layer 876. This connection isolates vertical slots 612VP2 from the feed structure (including layer 272) for the horizontal slots 612HP2 of FIG. 8*a*. Vertical slots 612VP2 are fed by a further electrically conductive feed arrangement illustrated as 1001, mounted on a support/isolation dielectric sheet 880. As illustrated in FIG. 8*a*, the feed conductors 1004 of feed arrangement 1001 extend across the slot, for exciting it, in a manner similar to that illustrated for slots 12HP1 and 12HP2 of FIG. 6, and as illustrated in FIG. 10. Since the feed structure 1001 for the vertical slots is in a separate plane from the feed structure 272 for the horizontal slots, the "landlocking" problem described in conjunction with FIG. 5 does not occur, and both portions, namely portions 12VP1 and 12VP2 of each of the vertical slots 12V, can be fed by the conductors of layer 1001. In order to maintain equal or balanced excitation for the vertical and horizontal slot portions, it is desirable that the vertical feed structure have the same form as the horizontal feed structure, so as to have the same losses. Since the horizontal feed structure is in the form of stripline, a further metallization layer 886, affixed or deposited onto a support/isolation dielectric layer 884, underlies vertical feed layer 1001.

In FIG. 8*a*, the transmit/receive (TR) modules 888*b* for the patch antenna subarrays 714' are more spaced apart, as each module, in this view, feeds a subarray 714' of four adjacent patch antennas 730*a*, 730*b*, 730*c*, and 730*d* (FIG. 7). If desired, a further ground plane, illustrated as 890, may be added below the layer of transmit/receive modules, to help to control unwanted radiation.

Figure 9:
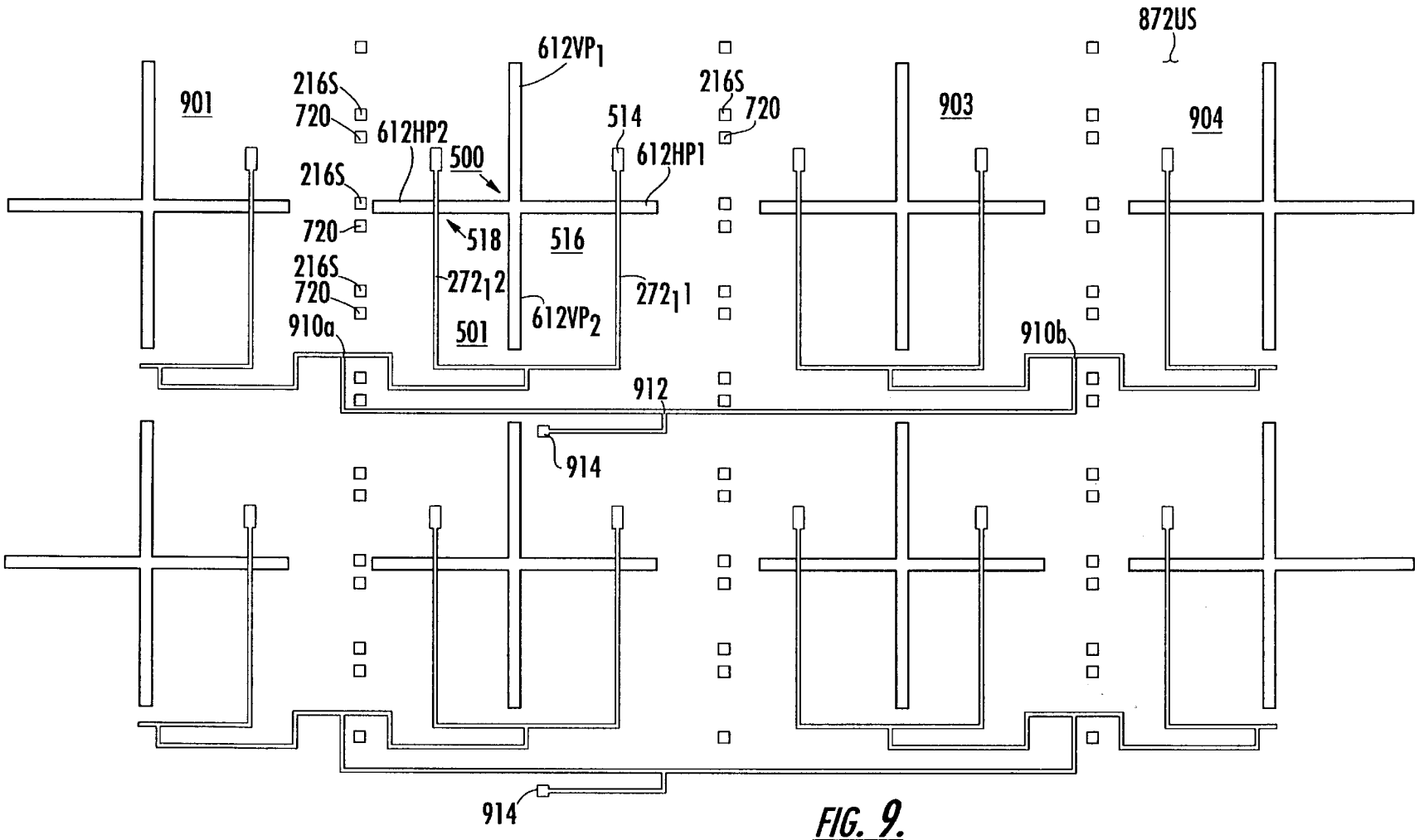
FIG. 9 is a simplified diagram illustrating the layout of a horizontal-polarization slot feed layer of the array of L-band crossed slot antennas co-located with an array of enhanced-gain C-band patch antennas of FIGS. 6, 7, 8*a*, and 8*b;*

FIG. 9 is a simplified diagram illustrating the layout of horizontal-polarization slot feed layer 272 of the array of L-band crossed slot antennas co-located with an array of enhanced-gain C-band patch antennas of FIGS. 6, 7, 8*a*, and 8*b*. In FIG. 9, locations designated 216*s* and 720 correspond to those locations at which the feed pins for the patch antenna subarrays penetrate the illustrated upper surface 872US of dielectric layer 872 of FIGS. 8*a* and 8*b*. Crossed-slot 500 in FIG. 9 has a feed structure designated generally as 501, which is fed at its feed point 510. Feed 501 includes junction 510, conductor path 272$_1$1 with capacitive termination 514, which conductor path crosses slot portion 612HP1 at location 516, and conductor path 272$_1$2 with its capacitive termination 520, which conductor path crosses slot portion 612HP2 at location 518. As also illustrated in FIG. 9, this particular embodiment of the antenna array feeds each subarray of four slots from a common feed point. More particularly, crossed-slots 901, 903, and 904, together with crossed-slot 500, are fed in common from a subarray feed point 914. A first power divider or splitter 912 divides the signal applied to feed point 914 into two portions, which propagate to further power splitters 910*a*, 910*b*, which again divide the power, and make it available to feed point 510 of crossed-slot 500, and to the corresponding feed points of the other crossed slots 901, 903, and 904 of the subarray.

FIG. 10 is a simplified diagram illustrating the layout of vertical-polarization slot feed layer 572 of the array of L-band crossed slot antennas co-located with an array of enhanced-gain C-band patch antennas of FIGS. 6, 7, 8*a*, 8*b*, and 9. The horizontal-polarization slot does not extend to the depth of the layer of FIG. 10. In FIG. 10, the vertical feed for each four-crossed-slot subarray originates at a representative feed point 1014 on upper surface 880US, and proceeds to a power splitter 1012, which divides the power into two portions. Each portion propagates by way of a path 572 to a further power splitter pair 1010*a*, 1010*b*, which again divide the signal into two portions. Each of the resulting four portions is applied to a feed point, corresponding to feed point 510, of a vertically-polarized slot of the subarray 901, 500, 903, 904, corresponding to vertically-polarized slot portions 612VP1 and 612VP2 of crossed-slot antenna 500. As in the case of FIG. 9, the locations at which the feed pins for the patch antenna subarrays penetrate dielectric layer 880 are indicated by marks designated 216s and 720.

The feed structure for vertically polarized slot portions 612VP1 and 612VP2 in FIG. 10 is designated generally as 1001. Feed structure 1001 includes splitter 1008, a first portion including conductor 1004, which crosses slot portion 12VP1 at a location 1016, together with the capacitive termination 1004*c* for conductor 1004. Feed structure 1001 further includes a second portion including conductor 1003, which crosses slot portion 12VP2 at a location 1018, and capacitive termination 1003*c*.

Figure 11:
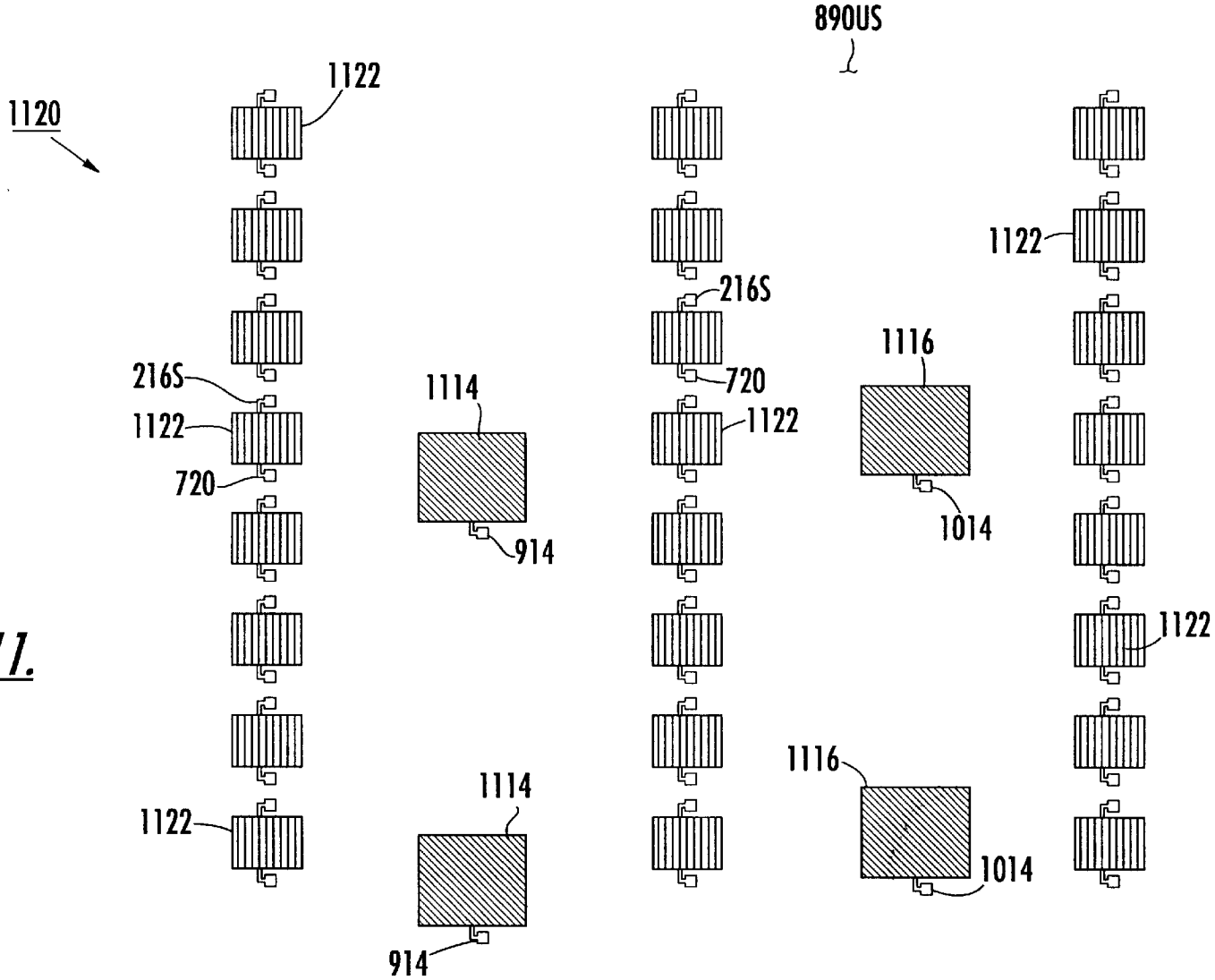
FIG. 11 is a simplified representation of the layout of TR modules for the L-band slot arrays and the C-band patch arrays described in conjunction with FIGS. 6, 7, 8*a*, 8*b*, 9, and 10.

FIG. 11 is a simplified representation of the layout of TR modules on the upper surface 890US for the L-band slot arrays and the C-band patch arrays. As illustrated in FIG. 11, the L-band modules 1114 for the first polarization (horizontal polarization) are connected to locations designated 914, which are registered with corresponding locations 914 associated with the horizontal polarization feed layer, so that a simple vertical pin or conductor can carry the signal to the horizontal polarization portions of the crossed slot subarrays. Similarly, the L-band modules 1116 for the second or vertical polarization are connected to locations designated 1014, which are registered with the corresponding locations of the vertical polarization feed layer illustrated in FIG. 10.

Also illustrated in FIG. 11 is an array 1120 of individual C-band TR modules, some of which are designated 1122, each of which produces signal for both vertical and horizontal polarization. Each module 1122 couples the horizontal-polarization signal to an associated location 216*s*, which is registered with corresponding locations in the patch antenna layer illustrated in FIG. 7. Similarly, each module 1122 couples the vertical-polarization signal to an associated location 720, registered with corresponding locations in the patch antenna layer of FIG. 7.

Figure 12:
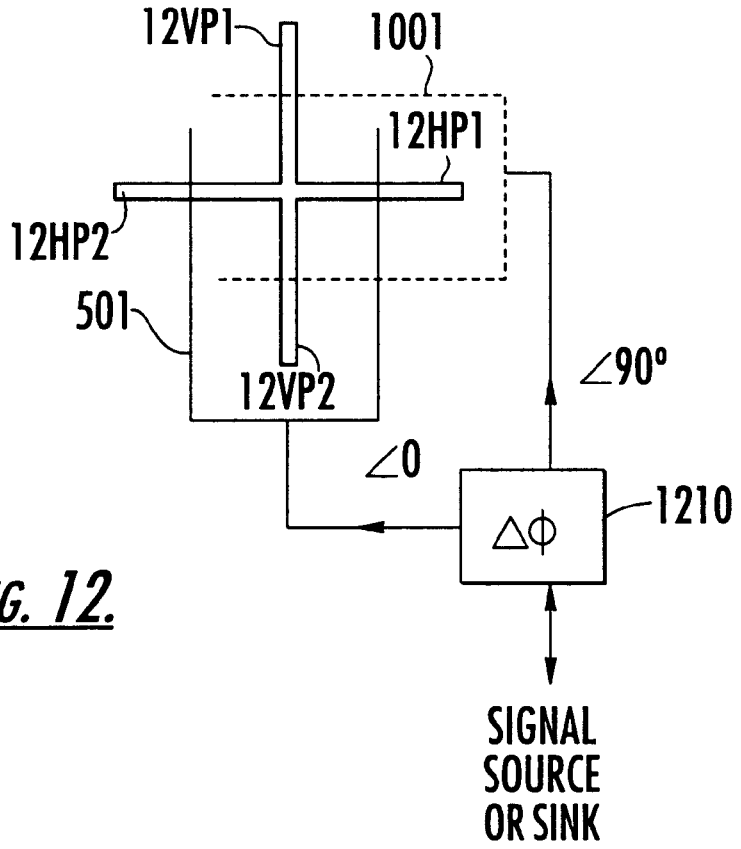
FIG. 12 is a simplified representation of a crossed-slot antenna with balanced feeds in disparate planes, showing how the feeds may be driven in phase quadrature for circular or elliptical polarization.

FIG. 12 is a simplified representation of an arrangement for generating or receiving circular or elliptical polarization. In FIG. 1, the feeds 510 and 1001, lying in different planes, are represented in skeletonized form. As illustrated, a phase shifting arrangement ($\Delta\phi$) 1210 couples a source or sink of signal to feed 501 with a reference 0° phase, and to feed 1001 with a relative 90° phase at a particular frequency within a band of operating frequencies, for responding to signal with or to circular polarization at that frequency, as known in the art. Those skilled in the art also know that circular polarization is only approximately achieved, even at the design frequency, since the radiation pattern differences between the vertical and horizontal portions of the crossed slot introduce unwanted amplitude differences which reduce the desired circular polarization to elliptical polarization. Similarly, as the frequency deviates from the center of the design frequency band, the phase shift tends to deviate from the desired 90°, which also degrades the polarization circularity. Those skilled in the art also know that the crossed-slot antenna according to the invention may be fed with individual, independent signals for simultaneous vertical and horizontal polarization.

Figure 13:
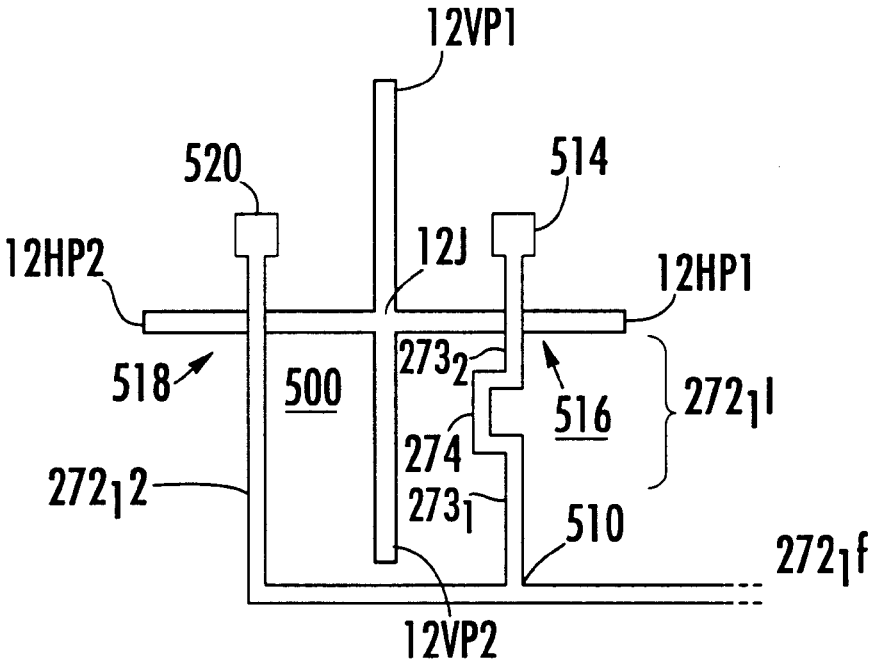
FIG. 13 is a simplified representation of an arrangement for driving a slot with an asymmetric feed.

FIG. 13 illustrates how a delay line may be used to compensate for an asymmetric feed. In FIG. 13, a crossed slot 500 includes vertical slot portions 12VP1 and 12VP2, and horizontal slot portions 12HP1 and 12HP2. The feed point for the horizontal slot portions, as in FIG. 5, is designated $\mathbf{272}_1f$. As illustrated, junction 510 is located closer to slot portion 12HP1 than to portion 12HP2. This difference in relative distance would translate into a greater path length for the feed or crossing 516 of slot portion 12HP2 compared with portion 12HP1, but for the presence of a delay or extension element 274, interposed between portions $\mathbf{273}_1$ and $\mathbf{273}_2$ of feed portion $\mathbf{272}_1\mathbf{1}$. The delay or extension element 274 makes up for the extra path length lying between junction 510 and crossing 518.

Other embodiments of the invention will be apparent to those skilled in the art. For example, those skilled in the art will recognize that additional dielectric layers may be used, as needed, to provide insulation and prevent short-circuits in the antenna. The various ground planes of the antenna should ideally be at the same potential, and this may be aided by providing electrical conductors extending through the layers and connecting the ground conductors to minimize voltage differences; other conductors may be folded over the adjoining edges of ground planes and make contact therewith, for the same purpose. Also, in the FIGURES, the terms "up" and "down," and corresponding terms ("overlain," for example) may, if not otherwise defined, be considered to be with reference to the illustration, and do not imply any particular orientation of the structure as represented in the illustration in question. While the patch antenna arrays have been described as having a layer of directors, the array may be used without directors, or with layers of directors exceeding the one layer illustrated. While four-patch-antenna subarrays have been described as being the basic driven elements of the higher-frequency array, those skilled in the art know that single patch antennas may be individually driven, and that the number of patch antenna elements in each subarray is a matter of choice. While the number of patch antenna subarrays lying between adjacent slot antennas has been described as being four, for a total of sixteen patch antennas, arranged in a square 4×4 array, any number of subarrays, having any number of elements, may be used, and may be arranged in other than a square pattern. While the shape of the individual patch antenna elements has been illustrated as square, such antenna elements can take on a large variety of shapes for various purposes, as known in the art, and the directors may have corresponding or non-corresponding shapes. While a capacitive termination for the feed conductors has been described, those skilled in the art realize that an inductive termination at a different position may accomplish the same result, and that terminations including resistive components may be appropriate for some applications.

A crossed slot antenna arrangement (12, 500, 612, with feeds) according to an aspect of the invention includes a first ground plane (30) or ground layer (30) having radiating (30*u*) and nonradiating broad sides. The first ground plane (30) defines a crossed slot (12) having first (12H) and second (12V) mutually orthogonal linear slots. These first (12H) and second (12V) slots cross at a junction (12J). Each of the linear slots (12H, 12V) includes a first (P1) and second (P2) portion. In a particular embodiment, the first (P1) and second (P2) portions of each linear slot (12H, 12V) are colinear, and separated by the junction (12J). The crossed slot (12) antenna arrangement (12, 500, 612) also includes a first electrically conductive feed ($272_1$1 of 501) lying parallel with, and adjacent, the nonradiating side of the first ground plane (30), and which extends across (at location 516) the first portion (12HP1) of the first linear slot (12HP1) for excitation thereof. A first dielectric layer (872) lies between the nonradiating side of the first ground plane (30) and the first electrically conductive feed ($272_1$1 of 501), as a result of which, or whereby, the first electrically conductive feed (501) takes on the general form of a first transmission-line structure. In a particular embodiment, the structure as so far recited is that of microstrip. A second electrically conductive feed (1004 of feed 1001) lies parallel with the first ground plane (30) and extends (at location 1016) across the first portion (612VP1) of the second linear slot (12V) for excitation thereof. A second ground plane (878) lies between the second electrically conductive feed (1004 of feed 1001) and the first electrically conductive feed (501), thereby providing a second ground plane for the first transmission-line structure, and whereby the second electrically conductive feed takes on the form of a second transmission-line structure. In the particular embodiment, the presence of the second ground plane (878) transforms the microstrip form of the first feed (501) into a stripline structure. A second dielectric layer (880) lies between the second electrically conductive feed (1001, including 1004) and the second ground plane (878). A third ground plane (884) extends parallel with the first ground plane (30), adjacent to the second electrically conductive feed (1001), at a location remote from the second dielectric layer (880), for thereby providing a second ground plane for the second transmission-line structure. In the particular embodiment, the presence of the third ground plane (884) transforms the second feed (1001) into a stripline form. An electrically conductive interconnection (214VP2*i*) is coupled to at least the first portion (12VP1) of the second linear slot (12V) and to the third ground plane (878), without contacting the first (501) and second (1001) electrically conductive feeds, for electrically interconnecting the second linear slot with the second transmission-line structure.

In a particular version of the crossed slot antenna arrangement (12, 500, 612), the first electrically conductive feed (501) includes a further portion ($272_1$2) extending (at location 518) across the second portion (12HP2) of the first linear slot (12H) for excitation thereof, the further portion ($272_1$2) of the first electrically conductive feed (501) including power splitting means (510) for feeding the first (12HP1) and second (12HP2) portions of the first slot (12H) with substantially equal amplitudes. In another version of the crossed slot antenna (12) arrangement, the second electrically conductive feed (1001) includes a further portion (1003) extending across the second portion (12VP2) of the second linear slot (12V) for excitation thereof, and the further portion (1003) of the second electrically conductive feed (1001) includes power splitting means (1008) for feeding the first (12VP1) and second (12VP2) portions of the second slot (12V) with substantially equal amplitudes.

In a particular atavar of the invention, the first (501) and second (1001) feeds are interconnected by a phase-shifting arrangement, for shifting the relative phases of signals provided by the first and second feeds to about 90° at a frequency within the operating frequency range of the crossed slot antenna (12) arrangement (12, 500, 612).

In a particularly advantageous version, the crossed slot (12) antenna arrangement (12, 500, 612) further includes at least one additional dielectric layer (716) lying adjacent the radiating side (30US) of the first ground plane (30), the additional dielectric layer (716) carrying a plurality of patch antennas (730*a*, 730*b*, 730*c*, 730*d*) overlying the radiating side (30US) of the first ground plane (30) at locations other than those of the first and second slots, for radiating at a frequency (C-band) higher than the operating frequency (L-band) of the crossed slot (12) antenna arrangement (12, 500, 612). A feed arrangement (720, 722, 724*a*, 724*b*, 216*s*) for the patch antennas (730*a*, 730*b*, 730*c*, 730*d*) includes apertures (A) extending orthogonally between the patch antenna layer or plane, through the first, second, and third ground planes.

What is claimed is:

1. A crossed slot antenna arrangement, comprising:

a first ground plane having radiating and nonradiating broad sides, said first ground plane defining a crossed slot having first and second mutually orthogonal linear slots, each of which slots includes a first and second portion;

a first electrically conductive feed lying parallel with said first ground plane and adjacent said nonradiating side of said first ground plane, and extending across said first portion of said first linear slot for excitation thereof;

a first dielectric layer lying between said nonradiating side of said first ground plane and said first electrically conductive feed, whereby said first electrically conductive feed takes the general form of a first transmission-line structure;

a second electrically conductive feed lying parallel with said first ground plane and extending across said first portion of said second linear slot for excitation thereof;

a second ground layer lying between said second electrically conductive feed and said first electrically conductive feed, thereby providing a second ground plane for said first transmission-line structure, and whereby said second electrically conductive feed takes on the form of a second transmission-line structure;

a second dielectric layer lying between said between said second electrically conductive feed and said second ground layer;

a third ground plane extending parallel with said first ground plane, adjacent to said second electrically conductive feed, at a location remote from said second dielectric layer, for thereby providing a second ground plane for said second transmission-line structure; and electrically conductive interconnection means coupled to at least said first portion of said second linear slot and to said third ground plane, without contacting said first and second electrically conductive feeds, for electrically interconnecting said second linear slot with said second transmission-line structure.

2. An antenna according to claim 1, wherein said first electrically conductive feed includes a further portion extending across said second portion of said first linear slot for excitation thereof, said further portion of said first electrically conductive feed including power splitting means for feeding said first and second portions of said first slot with substantially equal amplitudes.

3. An antenna according to claim 2, wherein said second electrically conductive feed includes a further portion extending across said second portion of said second linear slot for excitation thereof, said further portion of said second electrically conductive feed including power splitting means for feeding said first and second portions of said second slot with substantially equal amplitudes.

4. An antenna according to claim 1, wherein said first and second feeds are interconnected by phase-shifting means for shifting the relative phases of signals provided by said first and second feeds to about 900 at a frequency within the operating frequency range of said crossed slot antenna arrangement.

5. An antenna according to claim 1, further comprising second electrically conductive interconnection means coupled to at least said first portion of said first linear slot and to said second ground plane without contacting said first and second electrically conductive feeds, for aiding in electrically interconnecting said first linear slot with said first transmission-line structure.

6. An antenna according to claim 1, further comprising at least one additional dielectric layer lying adjacent said radiating side of said first ground plane, said additional dielectric layer carrying a plurality of patch antennas overlying said radiating side of said first ground plane at locations other than those of said first and second slots, for radiating at a frequency higher than the operating frequency of said crossed slot antenna arrangement.

7. A crossed-slot antenna arrangement according to claim 6, further comprising electrically conductive patch antenna feed means extending to at least some of said patch antennas, and isolated from said first and second feeds.

* * * * *